US010181665B2

(12) United States Patent
Ooshiro et al.

(10) Patent No.: US 10,181,665 B2
(45) Date of Patent: Jan. 15, 2019

(54) SUBSTRATE CONNECTING STRUCTURE

(71) Applicant: DENSO CORPORATION, Kariya, Aichi-pref. (JP)

(72) Inventors: Masahiro Ooshiro, Kariya (JP); Tatsuo Saito, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/506,524

(22) PCT Filed: Aug. 21, 2015

(86) PCT No.: PCT/JP2015/004213
§ 371 (c)(1),
(2) Date: Feb. 24, 2017

(87) PCT Pub. No.: WO2016/038814
PCT Pub. Date: Mar. 17, 2016

(65) Prior Publication Data

US 2017/0271794 A1 Sep. 21, 2017

(30) Foreign Application Priority Data

Sep. 10, 2014 (JP) ..... 2014-184156

(51) Int. Cl.
*H01R 12/00* (2006.01)
*H01R 12/71* (2011.01)
(Continued)

(52) U.S. Cl.
CPC ..... *H01R 12/716* (2013.01); *H01R 12/52* (2013.01); *H01R 12/7011* (2013.01);
(Continued)

(58) Field of Classification Search
CPC .. H01R 12/7047; H01R 13/748; H01R 24/76; H01R 12/716; H01R 12/7011
See application file for complete search history.

(56) References Cited

U.S. PATENT DOCUMENTS 4,929,185 A * 5/1990 Wong ..... F16B 35/041 361/810
6,805,575 B2 * 10/2004 Lappohn ..... H01R 9/18 439/381

(Continued)

FOREIGN PATENT DOCUMENTS

JP S61016884 U 1/1986
JP H08096905 A 4/1996

(Continued)

*Primary Examiner* — Xuong Chung Trans
(74) *Attorney, Agent, or Firm* — Harness, Dickey & Pierce, P.L.C.

(57) ABSTRACT

A substrate connection structure includes: a first substrate having a first conductive pattern and a first screw insertion hole disposed therein; a second substrate having a second conductive pattern and a second screw insertion hole disposed therein; a connector having a main body with an arrangement hole and a connection terminal; a restriction member arranged in the arrangement hole and having a screw through hole; a screw; and an attachment having a female screw. One end of the connection terminal is soldered on the first conductive pattern. The screw penetrates the second screw insertion hole, the screw through hole and the first screw insertion hole, and screwed into the attachment, so that the first substrate, the restriction member and the second substrate are connected each other, and the second conductive pattern is electrically connected to the other end of the connection terminal.

7 Claims, 4 Drawing Sheets

(51) Int. Cl.

| | |
|---|---|
| ***H01R 12/52*** | (2011.01) |
| ***H01R 12/70*** | (2011.01) |
| *H01R 4/34* | (2006.01) |
| *H01R 12/73* | (2011.01) |
| *H01R 107/00* | (2006.01) |

(52) U.S. Cl.
CPC ..... *H01R 12/7047* (2013.01); *H01R 4/34* (2013.01); *H01R 12/73* (2013.01); *H01R 2107/00* (2013.01); *H01R 2201/06* (2013.01)

(56) References Cited

U.S. PATENT DOCUMENTS

| | | | | |
|---|---|---|---|---|
| 6,863,543 | B2 * | 3/2005 | Lang | H01R 13/514 439/607.05 |
| 7,112,067 | B1 * | 9/2006 | Korsunsky | H01R 12/52 439/65 |
| 8,585,414 | B2 * | 11/2013 | Takeda | H01R 12/7005 439/160 |
| 9,209,540 | B2 * | 12/2015 | Raff | H01R 12/716 |
| 2002/0068478 | A1 | 6/2002 | Watanabe | |

FOREIGN PATENT DOCUMENTS

| | | | |
|---|---|---|---|
| JP | H08250243 | A | 9/1996 |
| JP | 2001135382 | A | 5/2001 |
| JP | 2002170610 | A | 6/2002 |
| JP | 2004119085 | A | 4/2004 |

* cited by examiner

SUBSTRATE CONNECTING STRUCTURE

CROSS REFERENCE TO RELATED APPLICATIONS

This application is a U.S. National Phase Application under 35 U.S.C. 371 of International Application No. PCT/JP2015/004213 filed on Aug. 21, 2015 and published in Japanese as WO 2016/038814 A1 on Mar. 17, 2016. This application is based on and claims the benefit of priority from Japanese Patent Application No. 2014-184156 filed on Sep. 10, 2014. The entire disclosures of all of the above applications are incorporated herein by reference.

TECHNICAL FIELD

The present disclosure relates to a substrate connecting structure for connecting electrically and mechanically two substrates facing each other.

BACKGROUND ART

Conventionally, a substrate connecting structure for connecting electrically and mechanically two substrates facing each other has a construction shown in FIG. 5. FIG. 5 shows, for example, a substrate connection structure 3 for connecting a main substrate 1 (as a first substrate) of a vehicular information device and a ICM substrate 2 (i.e., IVI complete module or in-vehicle information complete module) (as a second substrate) as a different substrate. The substrate connection structure 3 includes a connector 4 (or a compression connector) and a screw 5 with a head for screwing.

The connector 4, for example, has a main body 4*a* made of resin in which a nut 4*b* is embedded. Further, the main body 4*a* of the connector 4 includes multiple connection terminals 6. Each connection terminal 6 has a lower end 6*a* protruding from a bottom surface of the main body 4*a*, and an upper end 6*b* protruding from a top surface of the main body 4*a*.

The connection terminal 6 of the connector 4 is soldered on a pattern of the main substrate 1 by a flow-soldering manner. In this case, a fine gap is preliminarily formed between the connector 4 and the main substrate 1 in order to secure coplanarity (which is uniformity of an undermost surface of a terminal or an electrode in an element with respect to an attachment surface).

On the other hand, a first screw insertion hole 2*a* is formed in the ICM substrate 2. The screw 5 is inserted into the first screw insertion hole 2*a*, and the screw 5 is fastened with the nut 4*b*. In this case, the screw 5 is screwed until the upper end 6*b* of the connection terminal 6 sufficiently press-contacts the pattern of the ICM substrate 2. Here, a technique described in the Patent Literature No. 1 is similar to a technique of the substrate connection structure 3 having the above construction.

In the structure shown in FIG. 5, since a force at the time of fastening with the screw 5 is directly applied to a soldered portion of the connection terminal 6, large load is applied to the soldered portion. Accordingly, a contact failure may occur or a crack may arise at the soldered portion under usage environment (such as vibration and outside temperature change) of the vehicular information device. Further, the fastening force of the screw 5 functions a force for removing the lower end 6*a* of the connection terminal 6 from the main substrate 1, and therefore, the soldered portion may be separated.

PRIOR ART LITERATURES

Patent Literature

Patent Literature 1: JP-H08-250243-A

SUMMARY

It is an object of the present disclosure to provide a substrate connection structure in which a large load is not applied to a soldered portion between a connector and a substrate when facing two substrates are bonded.

According to an aspect of the present disclosure, a substrate connection structure includes: a first substrate having one surface on which a first conductive pattern is arranged and a first screw insertion hole disposed in the first substrate; a second substrate having one surface on which a second conductive pattern is arranged and a second screw insertion hole disposed in the first substrate; a connector including: a main body with an arrangement hole which penetrating between one end surface and an other end surface opposite to the one end surface; and a connection terminal arranged on the main body and having a spring function for connecting between the first and second conductive patterns of the first and second substrates, one end of the connection terminal protruding from the one end surface of the main body, and an other end of the connection terminal protruding from the other end surface of the main body; a restriction member arranged in the arrangement hole of the connector and including a screw through hole penetrating the restriction member in a same direction as the arrangement hole, a thickness dimension between both ends of the screw through hole in a penetrating direction being shorter than a separation distance between the one end and the other end of the connector in the penetrating direction under a free load state of the connection terminal; a screw; and an attachment having a female screw engageable with the screw. The connector is mounted on the first substrate under a condition that the one end of the connection terminal is soldered on the first conductive pattern of the first substrate. The screw penetrates the second screw insertion hole of the second substrate, the screw through hole of the restriction member and the first screw insertion hole of the first substrate under a condition that the second substrate is arranged to face the first substrate in a state where the second conductive pattern contacts the other end of the connection terminal. The first substrate, the restriction member and the second substrate are connected each other by screwing one end of the screw protruding from the first substrate into the attachment. The second conductive pattern is electrically connected to the other end of the connection terminal.

In the above substrate connection structure, since the fastening force of the screw is applied to the attachment, large force (such as a fastening force of the screw) is restricted from directly applying the soldered portion between the one end of the connection terminal and the first conductive pattern of the first substrate, different from a case where the fastening force of the screw is applied to the connector. Thus, the contact failure and generation of a crack are restricted at the soldered portion.

Further, the thickness dimension between two ends of the screw through hole in the restriction member in the penetrating direction is set to be shorter than the separate distance between the one end and the lower end of the connection terminal in the penetrating direction under a load free state of the connector. Thus, when fastening as described above, the second conductive pattern press-contacts the other end of the connection terminal. Therefore, the connection terminal and the second conductive pattern have surely electrical continuity (or electrically connected each other).

BRIEF DESCRIPTION OF DRAWINGS

The above and other objects, features and advantages of the present disclosure will become more apparent from the following detailed description made with reference to the accompanying drawings. In the drawings.

EMBODIMENTS

Figure 1:
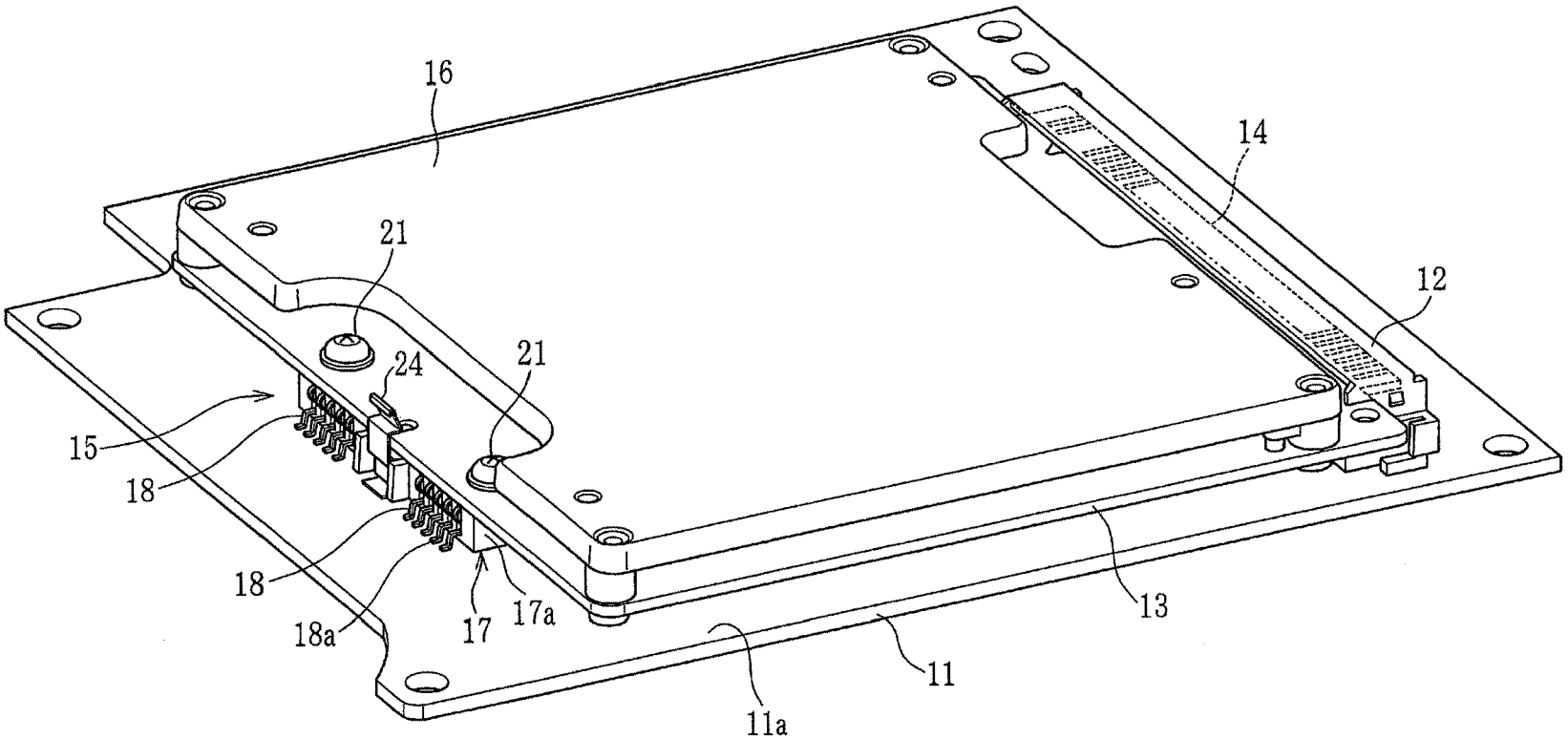
FIG. 1 is a diagram showing a substrate construction part of a vehicular information device according to a first embodiment of the present disclosure.
Figure 2:
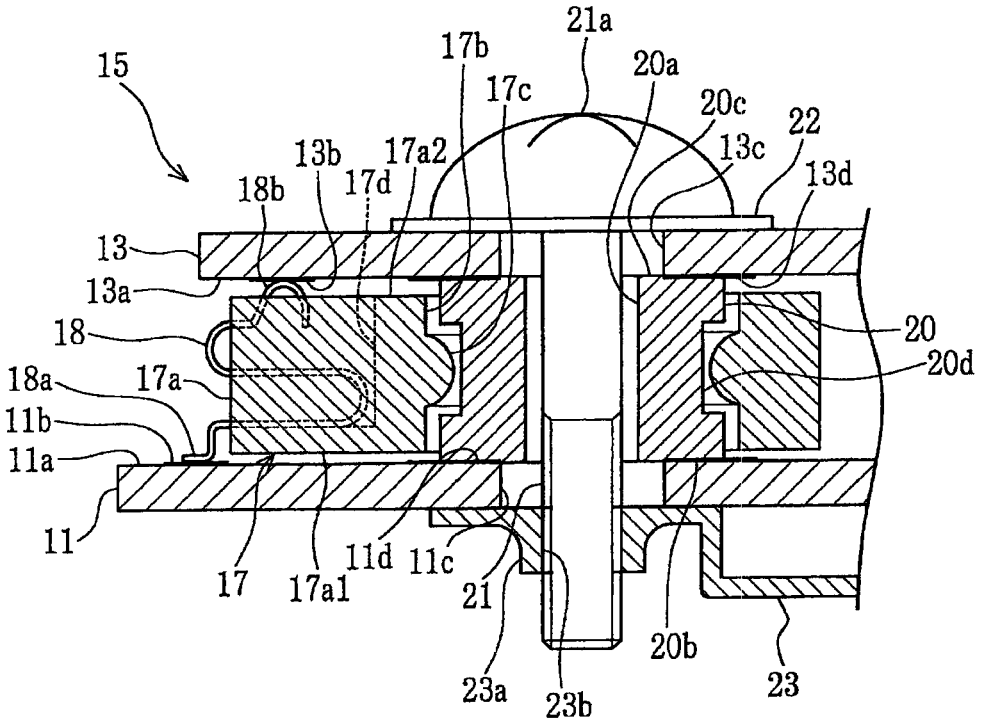
FIG. 2 is a diagram showing a vertical cross sectional view of a screw portion.
Figure 3:
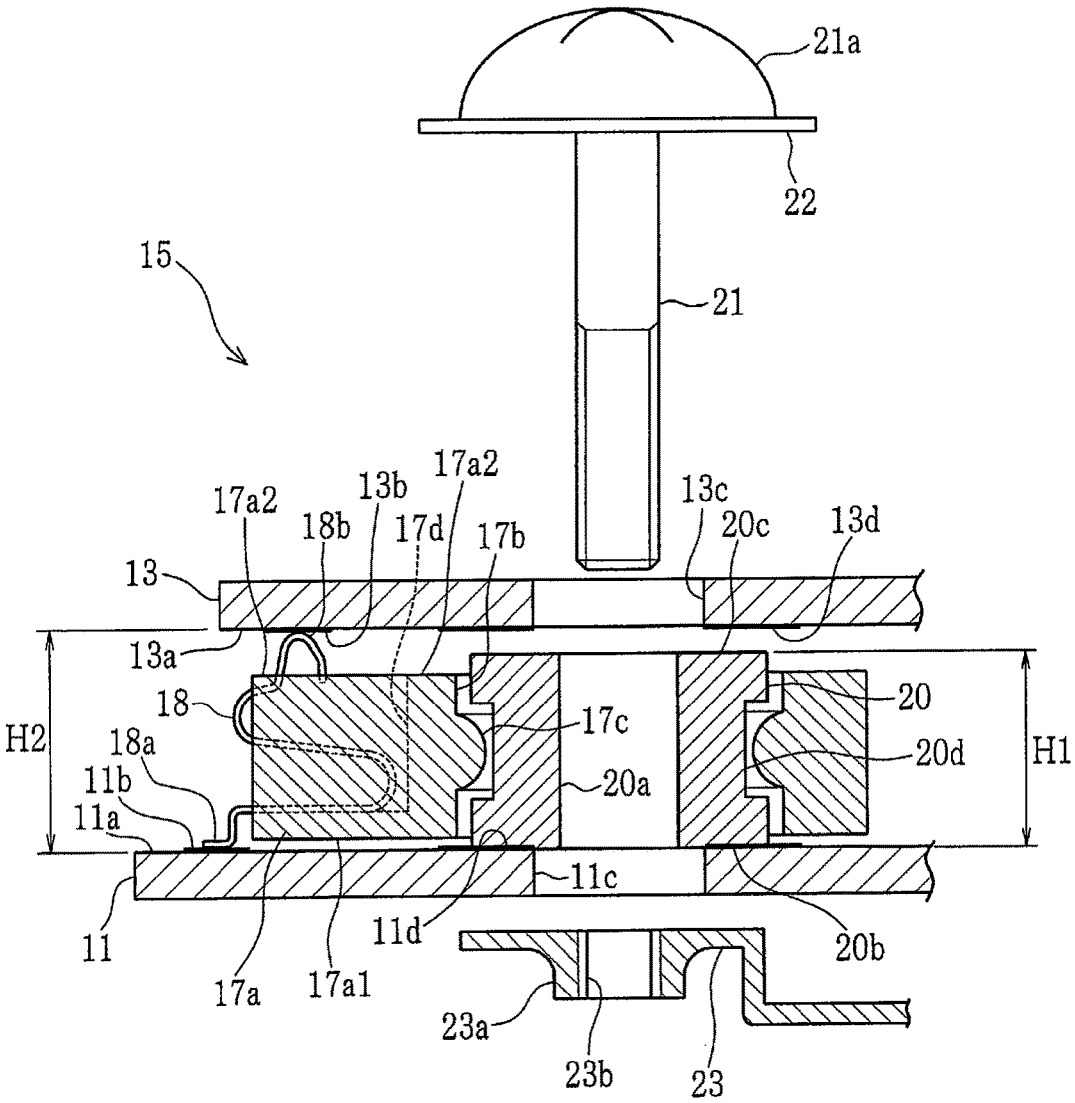
FIG. 3 is a diagram showing a vertical cross sectional view of a screw portion in an assembly process.

A first embodiment of a present disclosure will be explained with reference to FIGS. 1 to 3 as follows. On a right side of an upper surface 11*a* as one surface of a main substrate 11 corresponding to a first substrate in the drawings, an edge connector socket 12 is mounted. On the upper surface of the main substrate 11, an ICM substrate 13 corresponding to a second substrate is arranged so as to face each other. In this case, an edge connector 14 is formed on one end (i.e., a right end of the drawing) of the ICM substrate 13. The edge connector 14 is inserted and connected to the edge connector socket 12. Since the edge connector 14 and the edge connector socket 12 are connected each other, the right end of the ICM substrate 13 is electrically and mechanically connected to the ICM substrate 13.

The other end (i.e., a left end of the drawing) of the ICM substrate 13 is electrically and mechanically connected to the main substrate 11 through a substrate connection structure 15 described later. Here, a heat sink 16 is attached to the upper surface of the ICM substrate 13.

The above substrate connection structure 15 will be explained. FIG. 2 shows a vertical cross sectional view of a portion around a screw 21 in the substrate connection structure 15. On the upper surface (as one surface) 11*a* of the main substrate 11, a first conductive pattern 11*b* for providing a circuit is formed, and further, a first screw insertion hole 11*c* is formed. Further, on the upper surface of the main substrate 11, a conductive pattern 11*d* (as a conductor for a ground) for a ground is formed, and positioned around the first screw insertion hole 11*c*.

Further, on the lower surface 13*a* (corresponding to one surface) 13*a* of the ICM substrate 13, for example, a second conductive pattern 13*b* for providing a circuit is formed, and further, a second screw insertion hole 13*c* is formed. Further, on the lower surface 13*a* of the ICM substrate 13, a conductive pattern 13*d* (as a conductor for a ground) for a ground is formed, and positioned around the second screw insertion hole 13*c*.

The connector 17 is defined as a compression connector, and has a main body 17*a* made of resin. The main body 17*a* has a rectangular block shape extending in a front-rear direction of the drawing, as shown in FIG. 1. Each ends in the front-rear direction includes an arrangement hole 17*b* penetrating between the lower end surface (as one surface) 17*a*1 of the main body 17*a* and the upper end surface (as the other end surface) 17*a*2 opposite to the lower surface. A protrusion 17*c* protruding toward inside of the arrangement hole 17*b* is formed on an inner periphery of the arrangement hole 17*b*.

in the main body 17*a*, multiple slits 17*d* for terminal arrangement are formed. A connection terminal 18 having a spring function is arranged in each slit 17*d*. The lower end (as one end) 18*a* of the connection terminal 18 protrudes downwardly from the lower end surface 17*a*1 of the main body 17*a*. The upper end 18*b* of the connection terminal 18 protrudes upwardly from the upper end surface 17*a*2 of the main body 17*a*. The connection terminal 18 has a spring function, and a protrusion amount of the upper end 18*b* under a load free state shown in FIG. 3 is larger in the up-down direction than a state (under an assembly process) shown in FIG. 2.

A restriction member 20 is made of conductive material such as metal plate. The restriction member 20 is arranged in the arrangement hole 17*b* of the connector 17 slightly movably in the up-down direction (a through hole direction of the arrangement hole 17*b*). The restriction member 20 includes a screw through hole 20*a* arranged at an almost center of the member and penetrating the member 20 in the same direction as the arrangement hole 17*b*. As shown in FIG. 3, the restriction member 20 is designed such that the dimension H1 of thickness between both ends 20*b*, 20*c* of the screw through hole 20*a* in the through hole direction (i.e., the up-down direction) is shorter than the distance H2 in the through hole direction between the lower end 18*a* and the upper end 18*b* of the connection terminal 18 in the connector 17 under the free load state (shown in FIG. 3).

On an outer periphery of the restriction member 20, a concavity 20*d* is formed. The concavity 20*d* is engaged with the convexity 17*c* of the connector 17 with allowance. The restriction member 20 is arranged on the connector 17 by the engagement with the allowance in a state for preventing from falling off.

On the other hand, the screw 21 is made of a head screw. The screw 21 includes a washer 22 integrated with the screw 21 or arranged separately from the screw 21. The screw 21 and the washer 22 are made of conductive material.

The attachment 23 is made of conductive material such as a metal plate. The bar ring 23*a* is formed in the attachment 23. A female screw 23*b* for engaging the screw 21 is formed on an inner periphery of the bar ring 23*a*.

A case where the main substrate 11 and the ICM substrate 13 are connected to each other will be explained as follows.

The connector 17 is preliminarily mounted on the main substrate 11 under a condition that the lower end 18*a* of the connection terminal 18 is soldered on the first conductive pattern 11*b* of the main substrate 11 by the reflow solder manner. Further, since the lower end 18*a* of the connection terminal 18 protrudes from the lower end surface 17*a*1 of the main body 17*a*, a predetermined clearance for the coplanarity is formed between the lower end surface 17*a*1 of the connector 17 and the main substrate 11.

As described above, the edge connector 14 of the ICM substrate 13 is inserted and connected to the edge connector socket 12. At this time, as shown in FIG. 3, a surface of the ICM substrate 13 and a surface of the main substrate 11 face each other. Under the facing state, the second conductive pattern 13*b* of the ICM substrate 13 faces the lower surface 18*a* of the connection terminal 18 in the connector 17 in a touchable manner. Here, in this case, the connector 17 and the ICM substrate 13 are temporarily fixed with a holding spring 24 (shown in FIG. 1).

The screw 21 penetrates the second screw insertion hole 13*c* of the ICM substrate 13, the screw through hole 20*a* of the restriction member 20 and the first screw insertion hole 11*c* of the main substrate 1, and the end of the screw 21 protruding from the main substrate 11 is engaged with the female screw 23*b* of the attachment 23. Thus, the main substrate 11, the restriction member 20 and the ICM substrate 13 are fastened each other by the washer 22 of the head 21*a* in the screw 21 and the attachment 23. As a result, the main substrate 11 and the ICM substrate 13 are mechanically connected each other. Further, by the above described connection, the second conductive pattern 13*b* press-contacts the upper end 18*b* of the connection terminal 18 so that the connection terminal 18 and the second conductive pattern 13*b* are conductive.

By the above described connection, the lower end 20*b* of the restriction member 20 contacts the conductive pattern 11*d* for the ground, and the upper end 20*c* contacts the conductive pattern 13*d* for the ground.

In the above described embodiment, the screw 21 penetrates the second screw insertion hole 13*c* of the ICM substrate 13, the screw through hole 20*a* of the restriction member 20 and the first screw insertion hole 11*c* of the main substrate 1, and the end of the screw 21 protruding from the main substrate 11 is engaged with the female screw 23*b*. Thus, the main substrate 11, the restriction member 20 and the ICM substrate 13 are fastened each other. As a result, the main substrate 11 and the ICM substrate 13 are mechanically connected each other (i.e., mechanically coupled).

Thus, the fastening force (or the engagement force) of the screw 21 is directly applied to the attachment 23, so that large force (such as a fastening force of the screw) is restricted from directly applying the soldered portion between the lower end 18*a* of the connection terminal 18 and the first conductive pattern 11*b* of the main substrate 11, which is different from a case where the fastening force of the screw is applied to the connector. Thus, the contact failure and generation of a crack are restricted at the soldered portion under an usage environment (such as vibration and external temperature change) of the vehicular information device.

Further, in the present embodiment, the dimension H1 of the thickness between two ends 20*b*, 20*c* of the screw through hole 20*a* in the restriction member 20 in the penetrating direction is set to be shorter than the separate distance H2 between the lower end 18*a* and the upper end 18*b* of the connection terminal 18 in the penetrating direction under a load free state of the connector 17. Thus, when fastening as described above, the second conductive pattern 13*b* elastically deforms the upper end 18*b* of the connection terminal 18, and the conductive pattern 13*b* press-contacts the upper end 18*b*. Therefore, the connection terminal 18 and the second conductive pattern 13*b* are surely and electrically connected. Here, since the connection terminal 18 is elastically deformed, the elastic deformation force (i.e., a spring force) is applied to the lower end 18*a*. The direction of the force is in parallel to a direction for contacting the main substrate 11, and therefore, the soldered portion is not removed.

Further, in the present embodiment, the restriction member 20 is made of conductive material. By the above described connection, the lower end 20*b* of the restriction member 20 contacts the conductive pattern 11*d* for the ground, and the upper end 20*c* contacts the conductive pattern 13*d* for the ground. Thus, the conductive pattern 11*d* for the ground in the main substrate 11 and the conductive pattern 13*d* for the ground in the ICM substrate 13 are electrically connected via the restriction member 20. Thus, since the restriction member 20 are used as the connection conductor for the ground between two substrates 11, 13, it is possible to provide the electro-magnetic noise countermeasure easily by using the restriction member 20.

Further, in the present embodiment, the convexity 17*c* is formed on the connector 17, and the convexity 17*c* and the concavity 20*d* engaged with the convexity 17*c* with allowance are formed on the restriction member 20. Thus, the restriction member 20 is mounted in the arrangement hole 17*b* of the connector 17 in a state for preventing from falling off. Thus, when the parts management is performed, a pair of the restriction member 20 and the connector 17 is always managed, so that it is prevented from forgetting to prepare one of the restriction member 20 and the connector 17. Alternatively, the concavity and the convexity may be formed on opposite elements, respectively.

Figure 4:
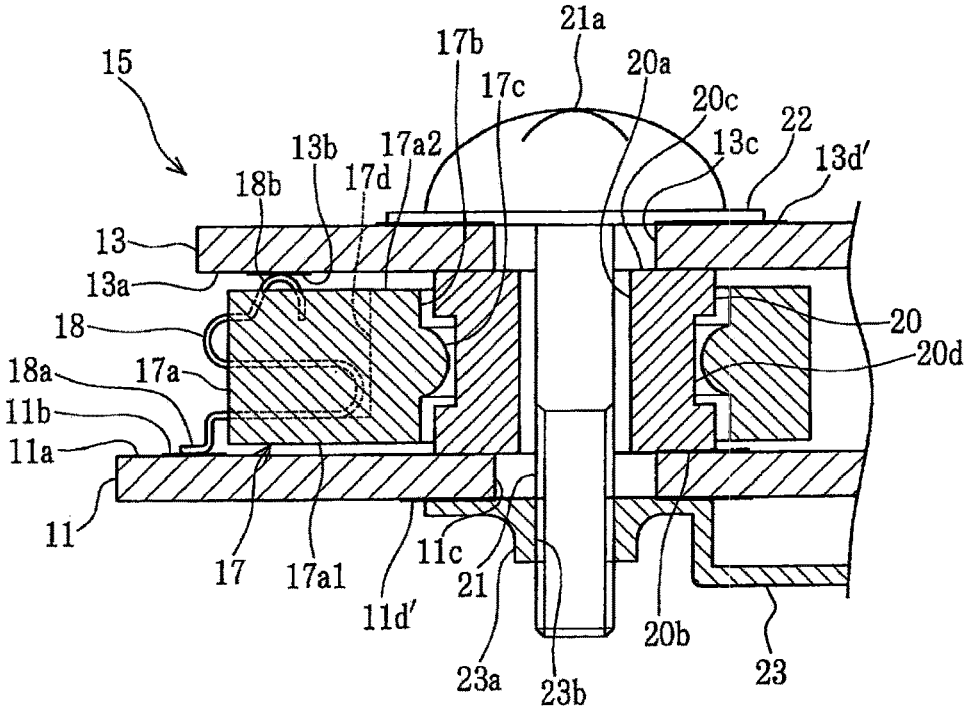
FIG. 4 is a diagram showing a vertical cross sectional view of a screw portion according to a second embodiment.
Figure 5:
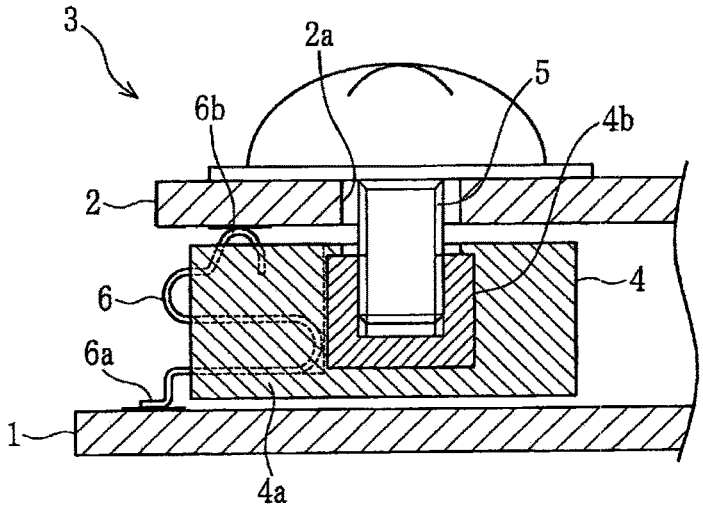
FIG. 5 PRIOR ART
FIG. 5 is a diagram showing a vertical cross sectional view of a screw portion according to a prior art.

FIG. 4 shows a second embodiment. In the second embodiment, a conductive pattern 11*d*' for the ground instead of the conductive pattern 11*d* for the ground in the main substrate 11 is formed on a lower surface of the main substrate 11 at a portion contacting the attachment 23. Further, a conductive pattern 13*d*' for the ground instead of the conductive pattern 13*d* for the ground in the ICM substrate 13 is formed on an upper surface of the ICM substrate 13 at a portion contacting the washer 22. Here, the screw 21, the washer 22 and the attachment 23 are made of conductive material, so that the conductive pattern 11*d*' for the ground and the conductive pattern 13*d*' for the ground are electrically connected each other via the washer 22 and the attachment 23. Specifically, the screw 21, the washer 22 and the attachment 23 are used as a connection conductor for the ground between two substrates 11, 13. Thus, by using the screw 21, the washer 22 and the attachment 23, it is possible to provide the electro-magnetic noise countermeasure easily. Here, the washer 22 may not be necessary. In this case, the head 21*a* of the screw 21 contacts and is electrically connected to the conductive pattern 13*d*' for the ground.

The main substrate for the vehicular information device is described as an example of the first substrate, and the ICM substrate is described as an example of the second substrate. Alternatively, two substrates may be various substrates for various devices.

In the drawings, a reference numeral 11 represents the main substrate (as the first substrate), a reference numeral 11*a* represents the upper surface (as one surface), a reference numeral 11*b* represents the first conductive pattern, a reference numeral 11*c* represents the first screw insertion hole, a reference numeral 11*d* represents the conductive pattern for the ground, a reference numeral 13 represents the ICM substrate (as the second substrate), a reference numeral 13*a* represents the lower surface (as one surface), a reference numeral 13*b* represents the second conductive pattern, a reference numeral 13*c* represents the second screw insertion hole, a reference numeral 13*d* represents the conductive pattern for the ground, a reference numeral 15 represents the substrate connection structure, a reference numeral 17 represents the connector, a reference numeral 17*a* represents the main body, a reference numeral 17*a*1 represents the lower end surface (as one end surface), a reference numeral 17*a*2 represents the upper end surface (as the other end surface), a reference numeral 17*b* represents the arrangement hole, a reference numeral 17*c* represents the convexity, a reference numeral 18 represents the connection terminal, a reference numeral 18*a* represents the lower end (as one end), a reference numeral 18*b* represents the upper end (as the other end), a reference numeral 20 represents the restriction member, a reference numeral 20*d* represents the concavity, a reference numeral 20*a* represents the screw through hole, a reference numeral 21 represents the screw, a referenced numeral 22 represents the washer, a reference numeral 23 represents the attachment, and a reference numeral 23*b* represents the female screw.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. A substrate connection structure comprising:

a first substrate having one surface on which a first conductive pattern is arranged and a first screw insertion hole disposed in the first substrate;

a second substrate having one surface on which a second conductive pattern is arranged and a second screw insertion hole disposed in the second substrate;

a connector including: a main body with an arrangement hole penetrating between one end surface and an other end surface opposite to the one end surface; and a connection terminal arranged on the main body and having a spring function for connecting between the first and second conductive patterns of the first and second substrates, one end of the connection terminal protruding from the one end surface of the main body, and an other end of the connection terminal protruding from the other end surface of the main body;

a restriction member arranged in the arrangement hole of the connector in an engagement state with allowance and including a screw through hole penetrating the restriction member in a same direction as the arrangement hole, a thickness dimension between both ends of the screw through hole in a penetrating direction being shorter than a separation distance between the one end and the other end of the connector in the penetrating direction under a free load state of the connection terminal;

a screw; and an attachment having a female screw engageable with the screw, wherein:

the connector is mounted on the first substrate under a condition that the one end of the connection terminal is soldered on the first conductive pattern of the first substrate;

the screw penetrates the second screw insertion hole of the second substrate, the screw through hole of the restriction member and the first screw insertion hole of the first substrate under a condition that the second substrate is arranged to face the first substrate in a state where the second conductive pattern contacts the other end of the connection terminal;

the first substrate, the restriction member and the second substrate are connected to each other by, screwing one end of the screw protruding from the first substrate into the attachment;

the second conductive pattern is electrically connected to the other end of the connection terminal;

the restriction member is arranged in the arrangement hole of the connector in a state for preventing from falling off such that a convexity of the connector having a spherical shape is engaged with a concavity of the restriction member having a rectangular shape; and a clearance is arranged between the one end surface of the main body and the first substrate.

2. The substrate connection structure according to claim 1, wherein:

the restriction member is made of conductive material; and the restriction member provides a connection conductor for a ground between the first and second substrates.

3. The substrate connection structure according to claim 1, wherein:

the screw and the attachment are made of conductive material; and the attachment provides a connection conductor for a ground between the first and second substrates.

4. The substrate connection structure according to claim 1, wherein:

the attachment has a trapezoid cross sectional shape with a curved oblique side.

5. The substrate connection structure according to claim 1, wherein:

the connection terminal is a continuous, uninterrupted connection terminal.

6. The substrate connection structure according to claim 1, wherein:

a clearance is arranged between the other end surface of the main body and the second substrate.

7. The substrate connection structure according to claim 6, wherein one surface of the restriction member contacts the first substrate, and an other surface of the restriction member contacts the second substrate.

* * * * *